United States Patent [19]

Markham

[11] Patent Number: 4,771,488

[45] Date of Patent: Sep. 20, 1988

[54] PREFABRICATED TILED COUNTER

[76] Inventor: George E. Markham, 101 Ricky Ct., Grass Valley, Calif. 95949

[21] Appl. No.: 9,834

[22] Filed: Feb. 2, 1987

[51] Int. Cl.[4] ..... A47K 1/04

[52] U.S. Cl. ..... 4/631; 52/35

[58] Field of Search ..... 4/631, 630, 637; 52/34–36, 302, 384, 747; 206/568, 223

[56] References Cited

U.S. PATENT DOCUMENTS

| | | | |
|---|---|---|---|
| 400,076 | 3/1889 | Greenaway . | |
| 1,038,551 | 9/1912 | Forsyth . | |
| 1,827,053 | 10/1931 | Veneman | 4/631 |
| 1,898,668 | 2/1933 | Jones et al. . | |
| 1,968,189 | 7/1934 | Bartels . | |
| 2,031,255 | 3/1934 | Deubelbeiss . | |
| 2,122,696 | 7/1938 | Poston . | |
| 2,154,036 | 4/1939 | Doherty . | |
| 2,193,018 | 3/1940 | Batcheller | 4/631 |
| 2,450,702 | 10/1948 | Watts | 4/637 |
| 2,549,415 | 4/1951 | Bonnell . | |
| 2,890,919 | 6/1959 | Hansen | 52/35 |
| 3,308,725 | 3/1967 | Nagin et al. . | |
| 3,521,418 | 7/1970 | Bartoloni . | |
| 3,992,825 | 11/1976 | May . | |
| 4,453,359 | 6/1984 | Robinson . | |

*Primary Examiner*—Henry J. Recla
*Assistant Examiner*—L. J. Peters
*Attorney, Agent, or Firm*—Leonard Bloom

[57] ABSTRACT

A prefabricated countertop having an exposed exterior formed from tile which is uniquely constructed to withstand the rigors of remote mass assembly fabrication, transport and display at a retail establishment, and purchase as an integral unit for installation at a remote premises. An underlying frame, formed from angle iron preferably, supports a bottom wall formed from lath upon which cementicious material is provided and adhesive applied on surfaces to be exposed allowing tile to be placed thereon for finished work. A sink basin may be placed through an opening provided in the countertop.

13 Claims, 2 Drawing Sheets

PREFABRICATED TILED COUNTER

FIELD OF THE INVENTION

The following invention related generally to prefabricated counter tops having a tiled top surface. More particularly, the invention concerns the structure for a tiled counter fabricated and assembled remote from a site of installation particularly used for premises having sinks in bathrooms, kitchens and the like.

BACKGROUND OF THE INVENTION

Kitchen and bathroom fabrication, when using tile, still requires the presence of an experienced tile setter who comes to the residence or other establishment, to hand install tile, piece by piece. Curiously, while mass production techniques exist for counter tops in general, prefab tiled counter tops have not yet been commercially displayed. Nontile prefabricated counters are available in building supply outlets to be matched with sinks, cabinets, etc. for subsequent transit in toto to the site of installation. In this way, the consumer can mix and match different components. This is not true however for tiled counters.

For example, should one decide to replace a sink in one's bathroom, on display in building supply warehouses, one can find a plurality of diverse sink support cabinets and a plurality of sink basins and faucet designs. However, should the consumer desire to use something other than formica or synthetic marble and requests tile, a professional tile setter must go to the house. This clearly raises the cost for bathroom renovation beyond what should be a minimum expenditure attainable my mass production techniques.

The following patents reflect the state of the art of which applicant is aware and is also tendered in response to applicant's acknowledged duty to disclose prior art. U.S. Pat. Nos.

3,992,825, May, Nov. 23, 1976;
3,521,418, Bartoloni, July 21, 1970;
2,122,696, Poston, July 5, 1938;
1,898,668, Jones, et al, Feb. 21, 1933;
1,038,551, Forsyth, Sept. 17, 1912;
400,076, Greenaway, Mar. 26, 1889;
3,308,725, Nagin et al, Mar. 14, 1967;
1,968,189, Bartels, July 31, 1934;
2,549,415, Bonnell, Apr. 17, 1951;
2,031,255, Deubelbeiss, Feb. 18, 1936;
2,154,036, Doherty, Apr. 11, 1939.
Brochure: H.B. Fuller Company prior to 1984.

None of these citations teach singularly or in any conceivable combination that which is the nexus of applicant's invention to be delineated hereafter.

For example, the patent to Doherty teaches the use of a constructional detail element to be used in the environment of baths and sinks which specifically "eliminates" the need for tile in which cementicious material is placed upon a sheet of lath 16 after the lath has been tack welded to an underlying pan. Optionally, the outer face of the panel can then be enameled and then baked to provide a durable surface. Suitable pigment may be employed in the glaze when enameling for aesthetics.

Deubelbeiss provides a seal adapted to circumscribe a bathtub which abuts adjacent tiles thereabove, in which conventional lath is fixed to a wall, and cementicious material is troweled thereon. The cementicious material allows placement of tiles in a conventional manner.

The patent to May teaches the use of a fiberglass shell which supports "sheet tile" through the use of adhesive. Each of the tiles on the sheet are interconnected. The remaining citations show the state of the art futher.

SUMMARY OF THE INVENTION

By way of contrast, the instant invention is directed to and claims a prefabricated counter having an exterior finish formed from tile segments. An underlying framework carries an expanded metal lath upon which cementitious material is placed. The top exposed surface of the cementitious material is then coated with tile adhesive which may or may not have an elastomeric as a constituent ingredient. The tile is placed thereon, and the entire fabrication occurs in a mass production factory so that a plurality of distinctive counters can be transported and put on display at a building supply showroom. Thereafter, a consumer can match a given tile configuration with appropriate other cabinets in custom designing a bathroom or kitchen and the entire counter component is placed on the supporting cabinet as one piece.

More particularly, the supporting framework defines a rectangular frame formed from angle iron serving as a peripheral side wall and shoulder that receives the expanded metal lath there within. If the counter is to include a hole to receive a sink or basin, the lath has a central cutaway to accomodate the passage of the basin therethrough, and a pair of sink supports extend between parallel longitudinal angle iron supports to straddle the sink and provide additional support.

When the prefabricated counter includes a backsplash, the framework includes an upwardly extending metal frame emanating from one longitudinally extending angle iron, and lath is attached thereto for reception of the cementitious material and then the adhesive.

The exterior surfaces of the thus assembled kit receives tile segments of any desireable pattern to customize the prefabricated counter. Edges of the tile that address the side walls of the frame have downwardly turned portions. This tile segment, known as a "bull nose", provides the finished surface around a peripheral edge circumscribing the counter.

When the sink is to be recessed within the counter, the two support rods extending between the longitudinal angle irons carries the lip of the sink, and quarter round tile circumscribes a top edge of the sink basin for decorative effect. Alternatively, the basin may have a belled upper portion which rests on the tile itself. Appropriate holes are provided to allow passage of faucets therethrough for expeditious installation of the counter and hardware.

OBJECTS OF THE INVENTION

Accordingly, it is a primary object of this invention to provide a prefabricated counter top formed from a plurality of tiles on its exterior and assembled at a factory, shipped as an integral unit and displayed as a component in a kit used for remodeling to minimize costs associated with tile setting in a bathroom or kitchen environment.

It is a further object of this invention to provide a device as characterized above which is durable in construction and in transit and lends itself to mass production techniques.

A further object of this invention contemplates a device as characterized above wherein diverse architectural effects are possible to provide a wide range of selection for the consumer.

It is yet a further object of this invention to provide a device as characterized above which allows various components associated with the prefabricated counter to be selected independently from the counter itself to provide diverse possibilities with respect to the overall architectural effect for the ensemble.

It is an object of this invention to provide a tiled countertop prefabricated at a site remote from ultimate installation having a frame forming a circumscribing band which includes an inwardly directed shelf disposed substantially in a horizontal plane, a lath fixed to the shelf and defining a support surface, a layer of cementitious material carried on the lath and supporting a plurality of tiles thereon fixed thereto by adhesive providing a finished exterior surface, whereby a preformed countertop has been formed which displays requisite structural rigidity for transit and display prior to installation in a permanent site.

A further object of this invention provides a remodeling kit for providing a moveable tiled countertop as a prefabricated integral unit which is installed upon one of many diverse standardized countertop supports to achieve flexibility in decorating design, wherein a frame formed from angle iron is oriented to define a circumscribing support for the countertop which facilitates transport due to frame strength, the angle iron oriented to provide an inwardly facing peripheral shelf disposed in a horizontal plane and a circumscribing vertical wall, lath fixed to the shelf to define a bottom wall, which together with the vertical walls of the angle iron defines an open top enclosure, cementitious material filling the enclosure, adhesive coating a top surface of the cementious material and an outer exposed surface of the vertical walls of the angle iron, and a plurality of tiles attached to the adhesive, whereby an integral moveable tiled countertop is provided and the cementitious material is totally encapsulated.

It is an object of this invention to provide a method for forming prefabricated tiled countertop including the steps of fabricating an enclosing frame from angle iron such that an inwardly extending shelf and upwardly extending outer wall is provided, attaching lath to the shelf to form a bottom wall, thus forming an open top container, filling the container with cementitious material and allowing the material to cure, applying adhesive to the cementitious material and along an outer surface of the outer wall, and setting tile on the adhesive, whereby a moveable countertop has been provided for display and then installation.

A further object is to provide the countertop as above wherein a backsplash plate is integrally formed with the tiled countertop including lath extending upwardly from the circumscribing band upon which tile can be fixed through adhesive means.

A further object of this this invention is to provide the countertop as above wherein the countertop includes an opening passing centrally through the countertop dimensioned to receive a sink basin therethrough.

A further object is to provide the countertop as above including further holes, smaller in dimension than the hole which accomodates the sink basin for receiving plumbing fixtures and allowing conduits to pass therethrough.

A further object is to provide the countertop as above wherein the backsplash includes support for the vertically upstanding lath comprising a metallic framework circumscribing the upwardly extending lath.

A further object is to provide the countertop above wherein the opening which receives the sink basin includes first and second rigidification rods which straddle the sink basin and are attached to the circumscribing band.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
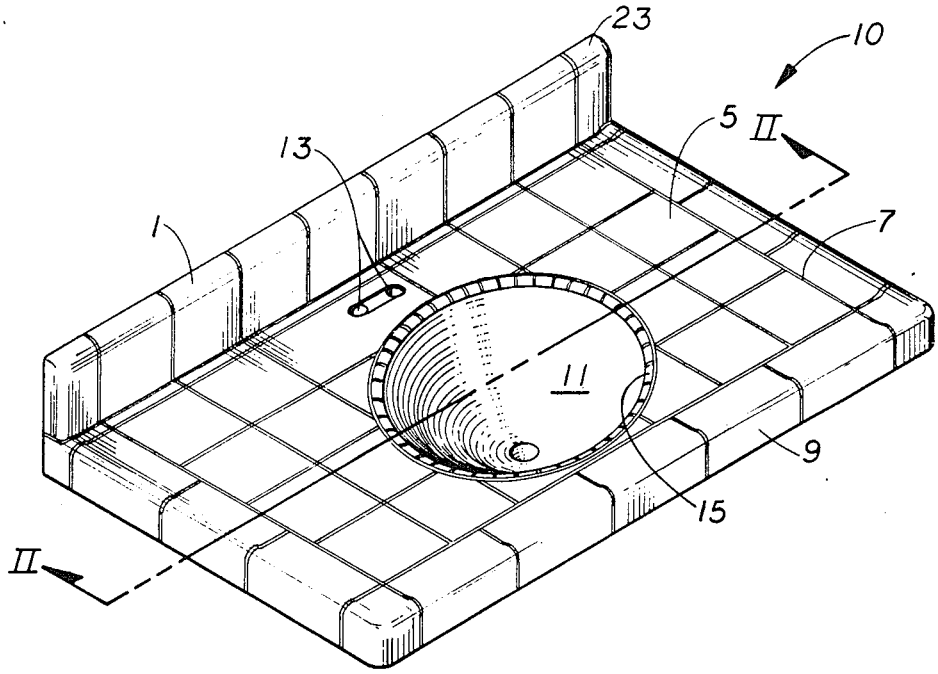
FIG. 1 is a perspective view of the apparatus according to one form of the present invention.

Referring to the drawings now, wherein like reference numerals refer to like parts throughout the various drawing figures, reference numeral 10 is directed to the prefabricated counter according to the present invention.

Figure 3:
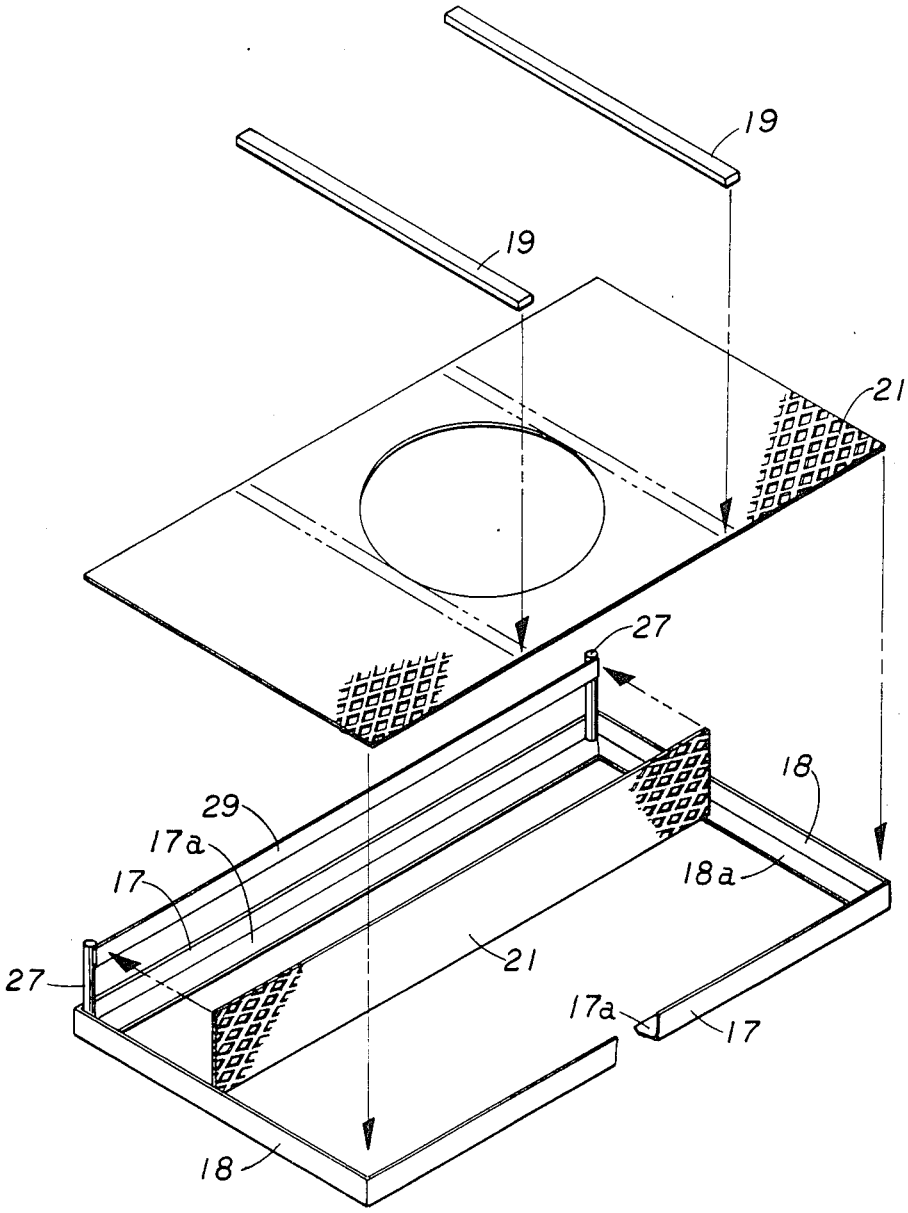
FIG. 3 is a perspective view of the framework according to the present invention with the parts exploded to show the assembly details.

As shown in FIG. 3, the framework for the counter 10 includes a substantially rectangular frame having longitudinal angle iron supports 17 in spaced parallel relationship, and latitudinal angle iron supports 18 interconnecting distal extremities of the longitudinal angle iron supports 17. Thus, a rectangular frame is formed that includes an interiorly disposed shelf 17*a*, 18*a* which supports an extended metal lath 21.

Corners on the angle iron supports and metal lath 21 can be tack welded to fix the framework in position, so that concrete 25 (FIG. 2) or other types of cementitious material can be placed thereon. For example, light weight concrete having "pearlite" can be used to reduce the overall weight of the counter depending upon the particular application and considerations with respect to flexing.

Some installations will benefit from a vertically extending rearwardly disposed backsplash, and to accomodate the backsplash, a further framework is shown in FIG. 3. A pair of vertically extending rebars 27 of substantially circular section extend from corners of one angle iron support 17 where it intersects with the latitudinal angle irons 18. A piece of rectangular stock material 29 is provided interconnecting the uppermost extremities of each rebar 27, and an expanded metal backsplash backing 21 is placed on a shelf 17*a* of the angle iron and fixed to the round stock rebar 27 and the rectangular bar stock 29. The reason for the round rebar 27 can be seen in FIG. 1 where corner pieces of bull nose tile 23 extend up from the splash plate. Tile 23 includes a radiused edge the interior of which (not shown) nests on and neatly accomodates the round rebar 27.

Some installations will require the placement of a sink basin through the prefabricated counter 10. Thus, a central hole is provided in the expanded metal lath 21 to allow clearance of the basin therethrough. Also, a pair of sink supports 19 formed from metal extend between angle iron supports 17 and parallel to the latitudinal supports 18. These sink supports 19 just straddle a sink 11 (FIG. 2) to firmly carry the sink within the counter. Since various sinks can be fit within a standardized opening, selection of the sink can be deferred until purchase of the counter and the sink at a building construction supply house to provide great flexibility in mixing and matching various designs.

Figure 2:
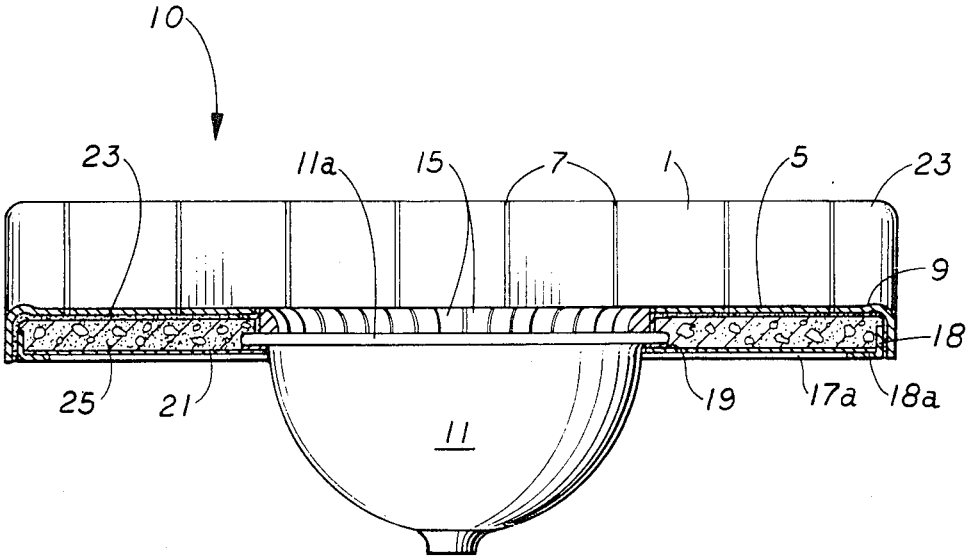
FIG. 2 is a sectional view taken along lines 2—2 of FIG. 1.

FIG. 2 shows an embodiment in which the sink 11 is recessed and a peripheral lip 11*a* rests on the sink support 19. In such an environment, a plurality of quarter round tiles 15 circumscribe a top edge of the sink 11 to provide a flush transition from the sink to the remainder of the tile 5 contained and defining the counter surface.

More particularly, the top most surface of the concrete 25 is finished with tile adhesive 23 and then the tile segments 5 are placed thereon. Grout 7 is placed between marginal edges of all tiles 5 for a professional finish. Where an edge of the counter 10 forms a transition between a horizontal and vertical plane, this peripheral edge is circumscribed by bull nose pieces 9 shown in FIG. 1. Also, the splash plate may or may not have the cement extending from the lath to the tile, but the tile adhesive 23 is used to fix the bull nose tile 1 there against.

Note the presence of holes 13 contained in one or more of the tiles 5 to allow faucet placement therethrough.

In addition, while a sink 11 has been depicted using quarter round tile 15, other versions of sinks are possible which include a belled top edge of sufficient magnitude so as to rest upon the tiles 5 which circumscribe the sink without the need of the quarter round tile 15.

Moreover, having thus described the invention, it should be apparent that numerous structural modifications are contemplated as being part of this invention as setforth hereinabove and as defined hereinbelow by the claims.

I claim:

1. A tiled countertop prefabricated at a site remote from ultimate installation comprising, in combination:

a four sided frame forming a circumscribing band which includes an inwardly directed shelf disposed substantially in a horizontal plane, a lath fixed to said shelf and defining a support surface, a layer of cementitious material carried on said lath and supporting a plurality of tiles thereon fixed thereto by adhesive means providing a finished, exterior surface, a backsplash plate is integrally formed with said tiled countertop including lath extending from one side of said four sided circumscribing band and defining a vertical support surface upon which tile can be fixed through adhesive means wherein said backsplash includes support for said vertical support surface comprising two upwardly extending members attached to said frame one side, and said members are interconnected by a rod, whereby a preformed countertop has been formed which displays requisite structural rigidity for transit and display prior to installation in a permanent site.

2. The countertop of claim 1 wherein said countertop includes an opening passing centrally through said countertop dimensioned to receive a sink basin therethrough.

3. The countertop of claim 2 including further holes, smaller in dimension than said hole which accomodates said sink basin for receiving plumbing fixtures and allowing conduits to pass therethrough.

4. The device of claim 3 wherein said opening which receives said sink basin includes first and second sink support rods which straddle said sink basin and are attached to said circumscribing band.

5. A remodeling kit for providing a removeable tiled countertop as a prefabricated integral unit which is installed upon one of many diverse standardized countertop supports to achieve flexibility in decorating design, comprising, in combination:

a frame formed from angle iron oriented to define a circumscribing support for the countertop which facilitates transport due to frame strength, said angle iron oriented to provide an inwardly facing peripheral shelf disposed in a horizontal plane and a circumscribing vertical wall, lath fixed to said shelf to define a bottom wall, which together with said vertical walls of said angle iron defines an open top enclosure, cementitious material filling said enclosure, adhesive means coating a top surface of said cementitious material and an outer exposed surface of said vertical walls of said angle iron, a plurality of tiles attached to said adhesive means, whereby an integral moveable tiled countertop is provided and said cementitious material is totally encapsulated and, a backsplash comprising a pair of rebars extending up from said frame and fixed to said angle iron to abut against said shelf and attached to a portion of said angle iron vertical wall, a piece of barstock connecting vertical extremities of said pair of rebars, and metal lath attached thereto which serves as a support for tile to be fixed thereon, said tile attached in a substantially vertical plane.

6. The kit of claim 5 including a centrally disposed opening within said countertop dimensioned to receive a standardized sink basin, said basin supported within said countertop kit by means of a pair of reenforcing rods straddling said basin and connected to said frame.

7. The kit of claim 6 wherein said frame is configured as a substantially rectangular support having two pairs of spaced parallel angle iron, each pair disposed at right angles with respect to the other pair and connected at extremities, said bars which straddle said sink interconnected to one pair of said angle irons supported on said horizontal shelf.

8. The kit of claim 7 wherein said angle irons, lath, rebars, and barstock are connected by tack welding.

9. The kit of claim 8 wherein a plurality of countertops are provided and diverse tiles having different architectural effect are displayed, said tiles completely cover all exterior surfaces of said countertop and only surfaces of the lath which are not to show upon installation have no tile.

10. A method for forming a prefabricated tiled countertop including the steps of:

fabricating an enclosing frame from angle iron such that an inwardly extending shelf and upwardly extending outer wall is provided, attaching lath to the shelf to form a bottom wall, thus forming an open top container, filling the container with cementitious material and allowing the material to cure, applying adhesive to the cementitious material and along an outer surface of the outer wall, forming the enclosing frame such that it is substantially rectangular configuration having a first pair of longitudinally extending angle irons and a pair of latitudinally extending angle irons, orienting in substantially vertical configuration first and second rebars at the intersection of one longitudinal angle iron and the pair of latitudinal angle irons such that the rebars are tack welded at the intersection thereof and extend vertically upward therefrom, attaching lath to the rebars such that the lath extends in a substantially vertical plane, and interconnecting vertical free end extremities of the rebar by means of a rigidification rod and attaching the rod to the lath, thereby forming a backsplash and, setting tile on the adhesive, whereby a moveable countertop has been provided for display and then installation.

11. The method of claim 10 including applying adhesive to the lath which forms the backsplash, and fixing tile thereon.

12. The method of claim 11 including providing a central opening through the container having cementicious material, and dimensioning the opening to accomodate a standardized sink basin.

13. The method of claim 12 including reinforcing the opening by a pair of rigidification bars extending between longitudinal angle irons.

* * * * *